United States Patent [19]

Miller et al.

[11] Patent Number: 4,864,505

[45] Date of Patent: Sep. 5, 1989

[54] POSTAGE METER DRIVE SYSTEM

[75] Inventors: Carl Miller, Fairfield; Richard Sloan, Jr., Oxford, both of Conn.

[73] Assignee: Pitney Bowes Inc., Stamford, Conn.

[21] Appl. No.: 87,010

[22] Filed: Aug. 19, 1987

[51] Int. Cl.[4] ..... G07B 17/00

[52] U.S. Cl. ..... 364/464.02; 101/91; 101/110

[58] Field of Search ..... 101/91, 110; 364/464, 364/464.02

[56] References Cited

U.S. PATENT DOCUMENTS

| | | | |
|---|---|---|---|
| 3,938,095 | 2/1976 | Check, Jr. et al. | 364/900 |
| 3,978,457 | 8/1976 | Check, Jr. et al. | 364/200 |
| 4,259,902 | 4/1981 | Eckert, Jr. et al. | 101/110 X |
| 4,302,821 | 11/1981 | Eckert et al. | 364/464 X |
| 4,631,681 | 12/1986 | Salazar et al. | 364/464 |
| 4,643,089 | 2/1987 | Salazar et al. | 101/91 |
| 4,731,728 | 3/1988 | Muller | 364/464 X |

*Primary Examiner*—Parshotam S. Lall
*Assistant Examiner*—Edward R. Cosimano
*Attorney, Agent, or Firm*—Charles G. Parks, Jr.; David E. Pitchenik; Melvin J. Scolnick

[57] ABSTRACT

A mailing machine for mounting of a suitable postage meter thereon includes means for initiating a postage meter print cycle. The postage meter includes a shutter means which will prevent full execution of the postage meter print cycle if not properly enabled. The mailing machine includes a shutter lever means in driving communication with the shutter means for controllably causing the shutter means to experience reciprocal motion. The mailing machine further includes control means for simultaneously causing the postage meter to begin a print cycle and cause the shutter lever means to being displacement of the shutter means. However, if the shutter means is not properly enabled, the control means will cause the shutter lever means to return to a home position for a retry.

9 Claims, 5 Drawing Sheets

POSTAGE METER DRIVE SYSTEM

BACKGROUND OF THE INVENTION

This invention relates to postage meter drive systems and, more particular, to means of driving the print drum and shutter bar of a postage meter such that the throughput of the postage meter mailing machine can be increased without necessitating an increases in the drive system operating speeds.

In a postage meter system of one type, a postage meter is provided that is separable from a mailing machine base. In this type of system, the mailing machine incorporates means for initiating print cycles of the postage meter, as well as driving means for driving the printing mechanism of the postage meter. In known equipment of the above type, the postage meter is provided with a printing drum which may incorporate either fixed or settable postage type. The drum is driven internally of the postage meter by a drive gear, the drive gear being adapted to be coupled to a driving gear in the mailing machine when the two units are intercoupled. The postage meter further incorporates a shutter bar adapted to be mechanically intercoupled to a shutter lever mounted in the mailing machine when the two units are interconnected. The shutter bar, or other suitable mechanical means coupled thereto, engage and prevent rotation of the drive gear, so that postage printing cannot be effectuated when the shutter is in its closed position. The shutter lever engages the shutter bar to effect the movement of the shutter bar to its open or release position upon the initiation of print cycle by suitable triggering means in the mailing machine. If the shutter bar of the postage meter is free to move, the shutter lever may thereby move the shutter bar out of blocking engagement with the drive gear. Conventionally, the mailing machine further incorporates a clutch operative by the shutter lever so that the driving gear in the base may be driven, to in turn drive the drive gear in the postage meter, only if the shutter bar is capable of being moved to its open position. The postage meter further incorporates various blocking, or interposing means, which prevent the operation of the shutter bar absent certain postage meter conditions, for example, the absence of adequate postage available as stored in a mechanical register in the postage meter itself, or the mounting of the meter on an improper base.

In systems of the aforementioned type, the mailing machine need not be secure from tampering, and may be a device sold as a retail item. The postage meter itself, however, is mechanically secure, i.e., it is enclosed in a secure housing so that the critical accounting and printing equipment cannot be tampered with, without rendering such tampering obvious to postal authorities upon inspection.

The advent of economical electrical control systems, especially microcomputer systems, has made it feasible to incorporate electronic accounting devices within the postage meter. Such electronic devices provide certain advantages, such as more rapid accounting of postage, to enable the use of the postage meters as a integrated part of high speed mail handling equipment. The electronic devices also may be economically produced providing the advantageous of light weight, reduced size and lower production cost of the postage meter devices. Further, electronic accounting means within the postage meter enables the meter to perform additional functions that are not otherwise readily achievable by mechanical means.

Electronic postage members of the above type are disclosed, for example, in U.S. Pat. Nos. 3,938,095, Check, Jr., et al. and 3,978,457, Check, Jr. et al.

A problem may arise in the use of an electronically accounting postage member in combination with high speed mail handling equipment, particularly high speed mailing machines. The problem arises from the accidental or intentional disruption of electrical power to the accounting registers of the postage meter during initiation of the printing cycle and subsequent to the release the postage member drive by the shutter bar. The printing cycle may then be completed without postage accounting as a result of power disruption to the electronic registers of the postage meter. U.S. Pat. No. 4,253,015, McFiggans et al., herein incorporated by reference, describes, among other things, a shutter bar, anti-reverse mechanism and register trigger arrangement which requires the completion of postage meter printing cycle after the print drum has been rotated beyond 10 to 20 degrees away from the home detented position notwithstanding disruption of electrical power to the postage meter.

It is noted that conventionally the drive actuation of the shutter bar and print drum are performed sequentially. That is, the shutter bar is actuated and delivered to its fully release position prior to actuation of the print drum.

SUMMARY OF THE INVENTION

It is an objective of the present invention to present a means whereby the initial movement of the print drum and the shutter bar mechanism is overlapped to effect a reduction in the print cycle time and thereby increase the throughput capability of the postage meter.

The shutter bar and print drum drive mechanisms within the postage meter are such that the print drum is free to rotate from the home detented position by approximately 15 degrees without being inhibited by the shutter bar. Accordingly, once the print cycle is to be commenced a drive mechanism is activated to withdraw the shutter bar from its blocking position. Simultaneously, the print drum drive mechanism is applied to start rotation of the print drum. The acceleration of the print drum is such that the initial acceleration from the home position is fairly small. When the print drum has rotated about 4 degrees, the shutter bar should now have been positioned at the fully forward or release position provided the postage meter is properly enabled to dispense the postage. An optical sensor attached to the system will be turned "Off" when the shutter bar reaches its fully forward or release position. In such a normal condition, the print cycle would be allowed to continue. However, in case the shutter bar can not be properly withdrawn from its blocking position occasioned by power disruption to the postage meter or insufficient funds within the postage meter or upon the occurrence as such other preselected postage meter event, the print drum is slowed down quickly to a complete stop within approximately one more degree of rotation. At this time the print drum is approximately 5 degrees from the home position and the anti-reverse rotation mechanism has not become active. So the print drum can now be rotated backward to its home position. The shutter bar is also driven back to its blocking (print-inhibit) position.

DETAILED DESCRIPTION OF THE PREFERRED EMBODIMENT

Figure 1:
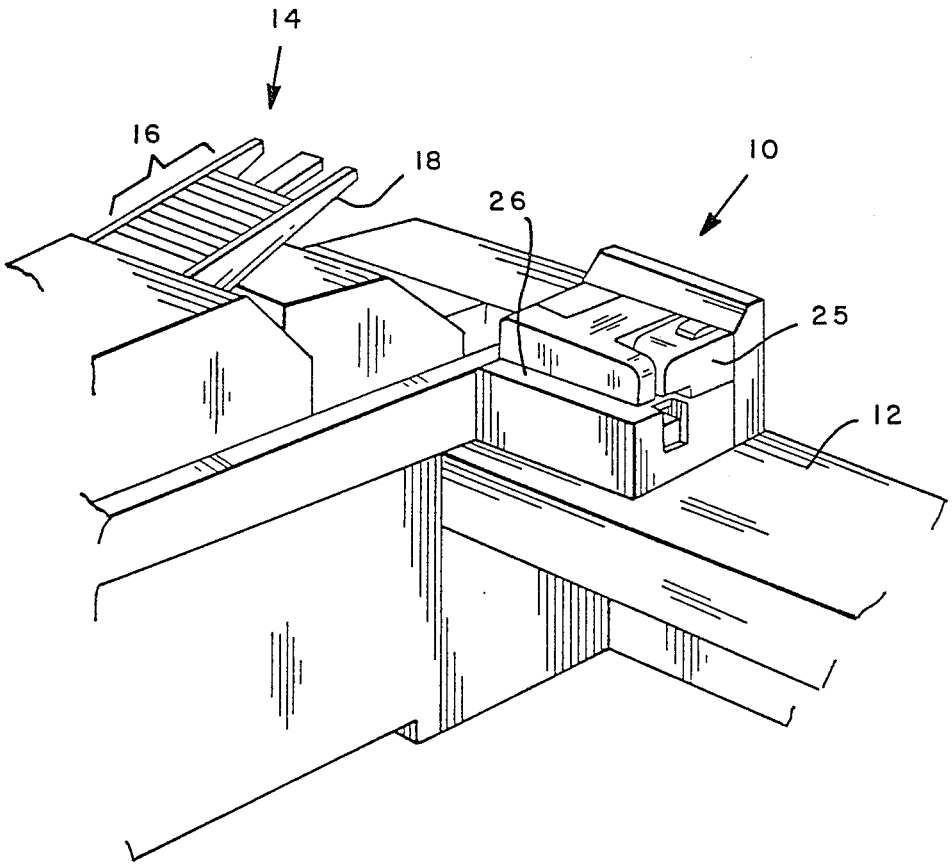
FIG. 1 is a partial prospective view of a postage meter mailing machine and an inserter.

Referring to FIG. 1, there is shown a mailing machine, generally designated by the reference numeral 10, mounted atop a support table 12 by any suitable means. The mailing machine 10 is positioned at a right angle to a generally conventional inserter 14. Conventionally, a stack of envelopes 16 are deposited in the receiving trays 18 of the inserter 14. The inserter 14 function in-part to deposit in each envelope a set of fill materials. The filled envelopes are then delivered to the mailing machine 10 in a seriate manner from the inserter 14. The mailing machine 10 includes a feed deck 26 for receiving the envelopes from the inserter 14 and a transport system for transporting the envelope upon arrival to a postage meter 25 for the printing of a postage indicia thereon.

Figure 2:
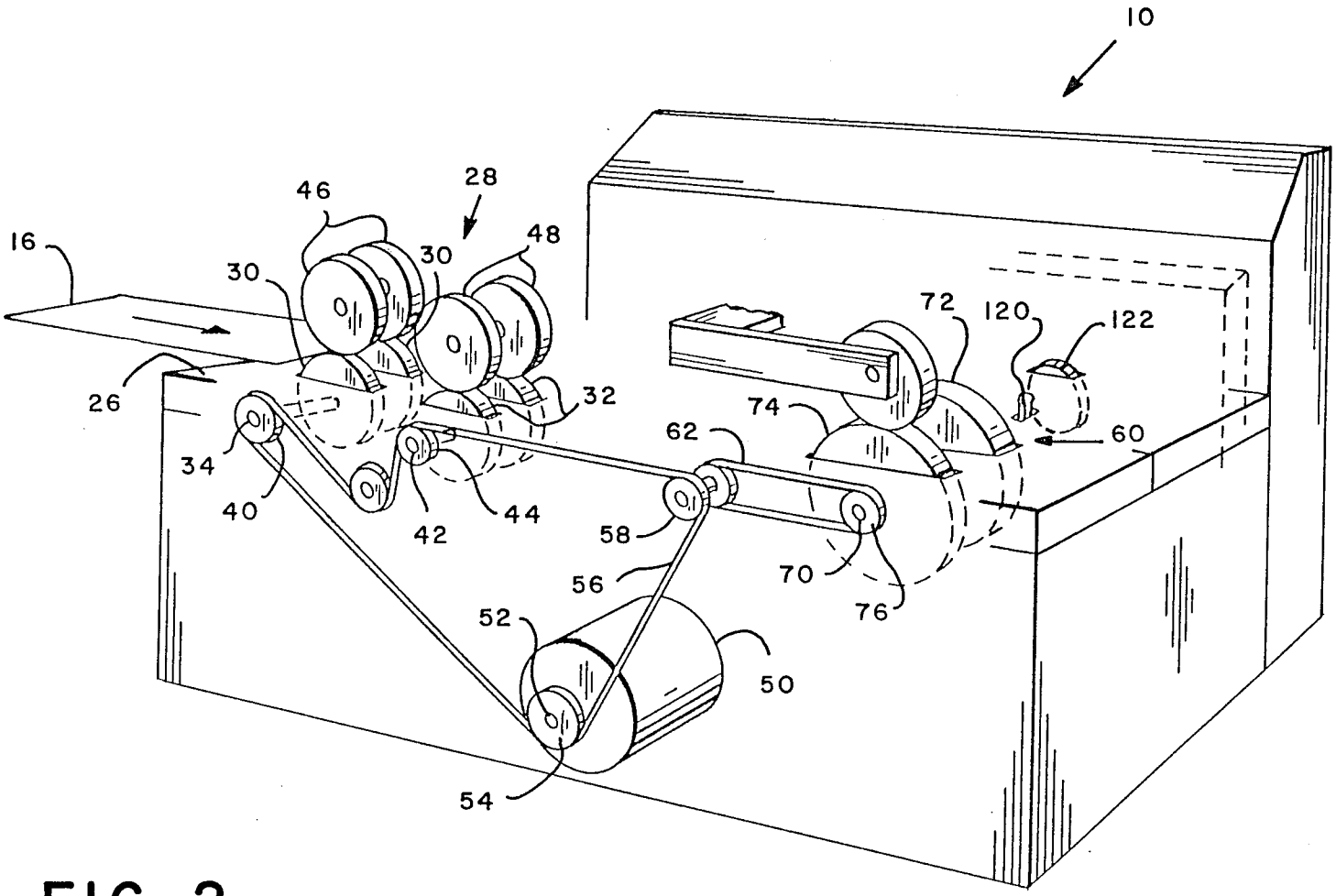
FIG. 2 is a simplified illustration of a mailing machine in accordance with the present invention.

Referring more particularly to FIG. 2, an envelope 16 directed to the mailing machine by the inserter 14 is received by the mailing machine transport assembly, generally indicated as 28 and more fully described in U.S. Pat. No. 4,787,311, incorporated herein by reference. The envelope 16 is placed under the positive control of the transport assembly 28 subsequent to introduction to the feed deck 26 which control is maintained throughout the envelopes' traversing journey across the mailing machine 10.

Generally, the transport assembly 28 includes a plurality of lower rollers 30 and 32. For drivingly supporting the lower rollers 30, a shaft 34 is rotatably mounted by conventional means within the mailing machine just below the feed deck 26. The shaft 34 drivingly supports the rollers 30 in axially spaced apart relationship. Drivingly mounted to the forward end of the shaft 34 by convention mean is a sprocket gear 40. A second shaft 42 is rotatably mounted within the mailing machine, in like manner to shaft 34, shaft 42 drivingly supports rollers 32 and has a second sprocket gear 44 drivingly mounted to the forward end thereof. To accommodate a portion of roller 30 and 32 above the feed deck 26 surface, a plurality of slots 46 are located in the feed deck 26 vertically aligned, respectively, to the placement of roller 30 and 32.

The transport assembly 28 further includes a support means (not shown) for rotatably supporting rollers 46 in vertical alignment to a respective roller 30 and rollers 48 in vertical alignment to a respective roller 32.

A stepper motor 50 is fixably mounted by conventional means within the mailing machine. The output shaft 52 of the stepper motor 50 has fixably mounted therearound a sprocket gear 54. An endless chain 56 provides driving communication between sprocket gear 54 and sprocket gears 40 and 44. The chain 56 also communicates with an double sprocket gear 58. The transport assembly 28 further includes means to maintain control of the envelope during the time the envelope is traversing the print station, generally indicated as 60. For providing the additional control, the transport assembly further includes an endless chain 62 placed around sprocket 58 such that chain 56 drives sprocket 58 which in-turn drives chain 62. A shaft 70 has drivenly mounted thereto by conventional means at point along its length, in outward order, a impression roller 72, a preposition roller 74 and a second gear 76. The chain 62 driven by chain 56 in-turn drives the gear 76 and resultingly the shaft 70. It is noted that the feed deck 26 of the mailing machine contains slots for accommodating a portion of impression roller 72 and preposition roller 74 to protruding therethrough.

Figure 3:
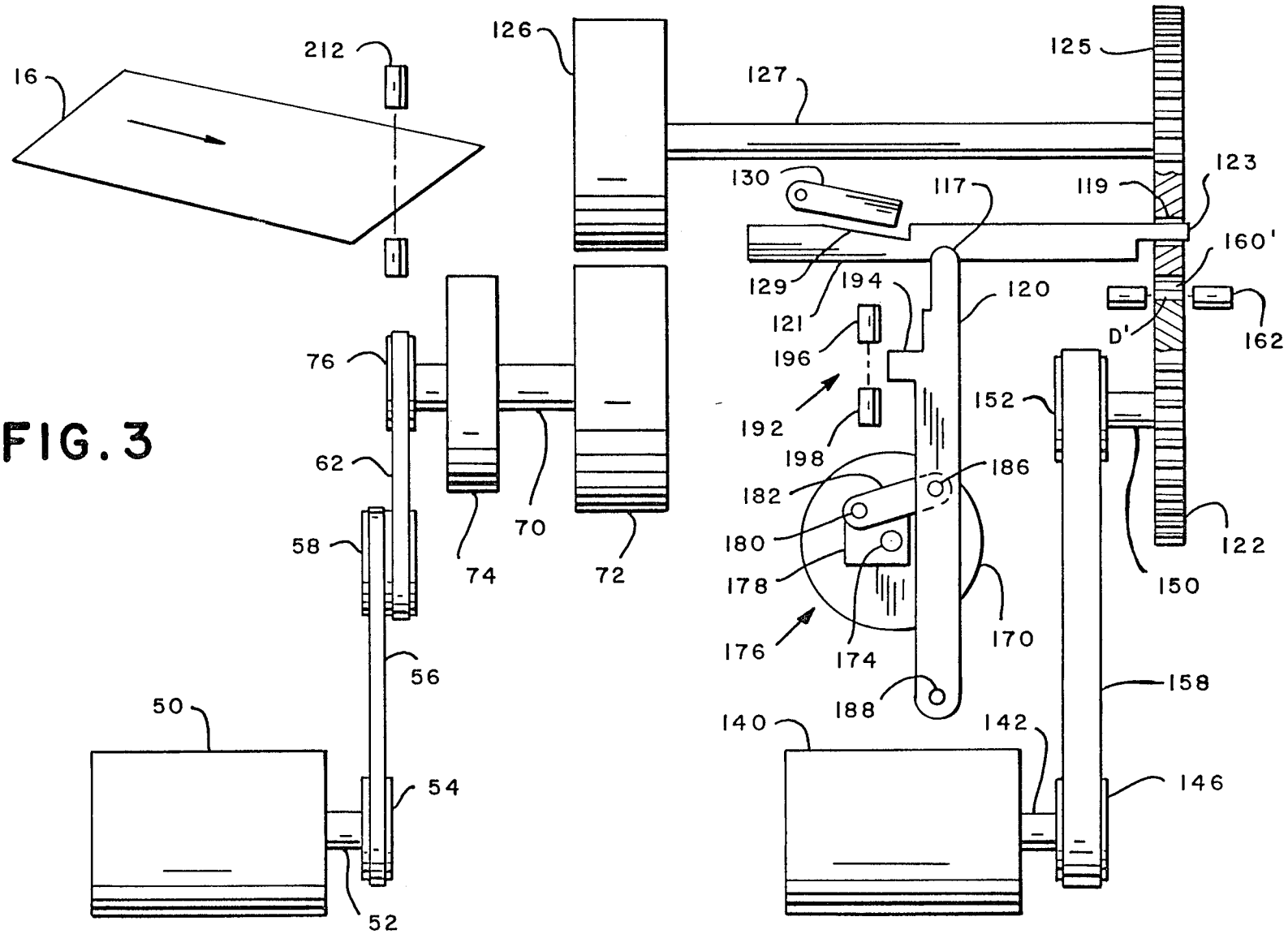
FIG. 3 is a simplified illustration of a postage meter mailing machine drive system in accordance with the present invention.

Referring to FIG. 3, a suitable postage meter 25, for example, a Pitney Bowes Postage Meter Model Series 5300, generally includes a print drum 126 fixably mounted to one end of a rotatably supported shaft 127 by conventional means. The postage meter 25 is mounted to the mailing machine by conventional means such that the print drum 126 is located opposite the impression roller 72 generally referred to collectively as the print station 60. The other end of shaft 127 has a driven gear 125 fixably mounted thereto by any conventional means. Slidably mounted within the postage meter is a shutter bar 121. The shutter bar 121 is mounted such that tabbed end portion 123 can be slidably admitted to and withdrawn from an aperture 119 in the gear 125. The shutter bar 121 is provided with a notch 129 sized for receiving a pawl or bail 130. The pawl 130 is positionable from a first position residing in the pawl 130 for inhibiting movement of the shutter bar to a second or release position displaced out of the notch 129. The pawl 130 is motivated by any conventional means such as a two position solenoid (not shown) upon instruction by the postage meter. The shutter bar 121 is further provided with a notch 117 or the like for pivotally receiving one end of a shutter bar lever 120 described subsequently.

Figure 4:
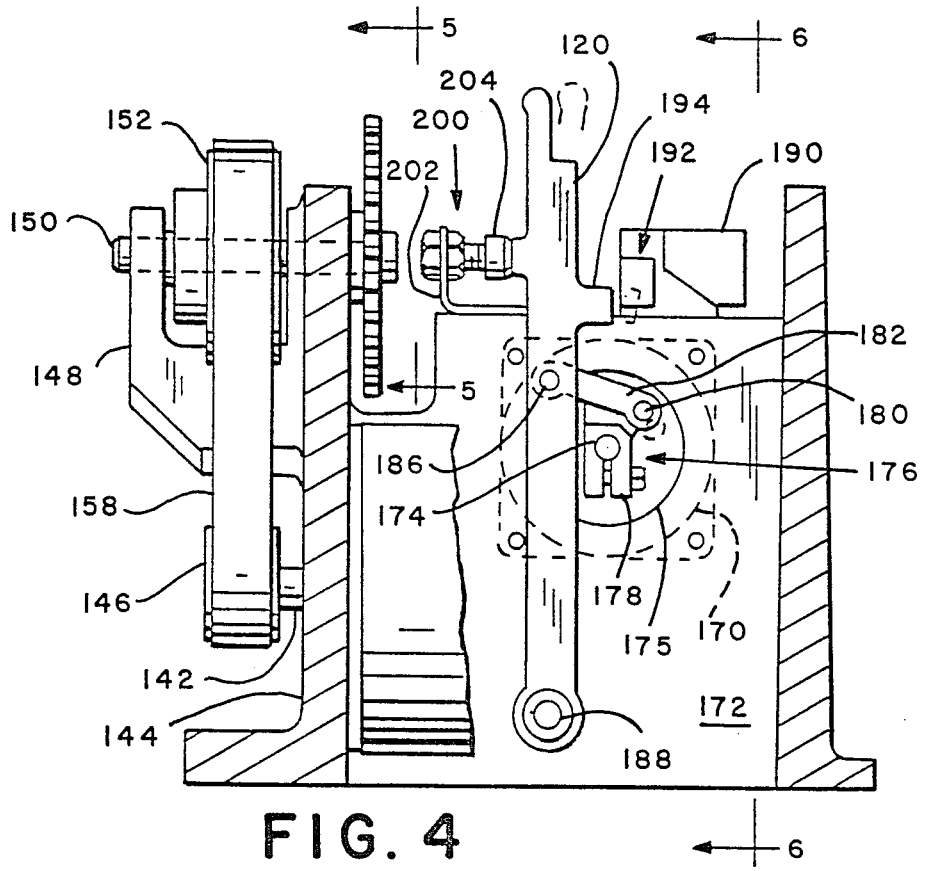
FIG. 4 is a side elevational view of the mailing machine postage meter drive assembly in accordance with the present invention.
Figure 6:
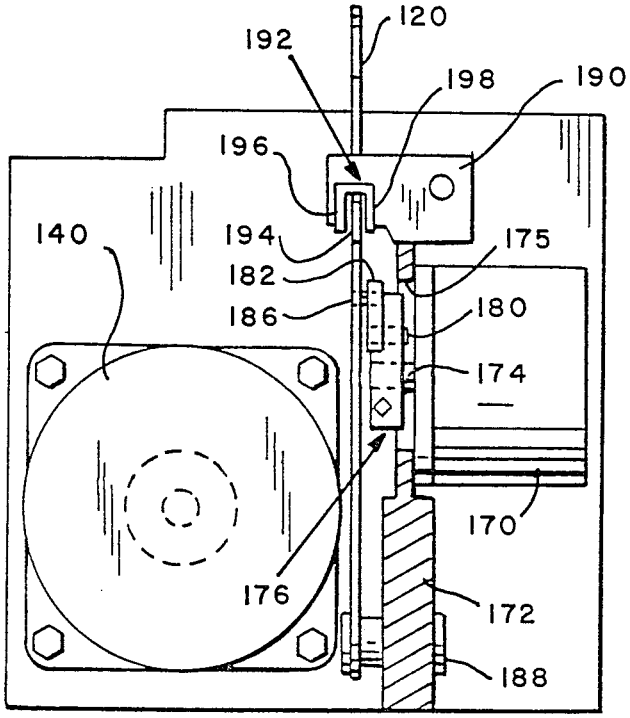
FIG. 6 is a side elevational view of the mailing machine postage meter drive assembly along line 6—6.
Figure 5:
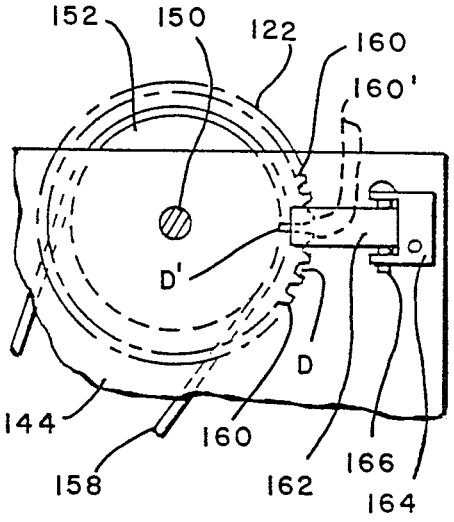
FIG. 5 is a side elevation view of the mailing machine postage meter drive assemble along line 5—5.

Referring in addition to FIGS. 4, 5 and 6, the postage meter drive system, includes a stepper motor 140 fixably mounted by conventional means in the base of the mailing machine 10 such that the output shaft 142 of stepper motor 140 extends through a aperture in a mailing machine support wall 144. A belt drive wheel 146 is fixably mounted by conventional means to the end of the stepper motor output shaft 142 beyond the support wall 144. Support wall 144 includes a formed yoke portion 148 having one of the yoke arms formed by a portion of the support wall 144. Rotatable mounted by conventional means between the arms of the yoke 148 is a shaft 150. One end of the shaft 150 extends beyond the support wall 144 and has fixably mounted thereto the gear 122. Fixably mounted by conventional means between the arms of the yoke 148 is a belt driven wheel 152. An endless belt 158 extends around portions of wheels 146 and 152 to provide driving communication between the stepper motor 140 and gear 122.

Gear 122 includes a plurality of gear teeth 160 formed completely around the outer periphery of gear 122. The gear teeth 160 of the gear 122 are uniformly spaced apart having a generally uniform special separation depth "D" (refer to FIG. 5). However, the gear 122 includes a single non-uniformity in the spacial separation depth, indicated as "D", between a single pair of adjacent gear teeth indicated as 160'. An optical sensor 162 is fixable mounted by any conventional means such as by a pin 166 to a mounting member 164 forming on support wall 144. The optical sensor 162 is positioned such that a radial portion of the gear 122 is between the sensor's arms such that optic communication between sensor arms is blocked "OFF" by the gear 122 except when the gear 122 is in the home position, i.e., optic communication between the sensor arms is only permitted when the gear 122 is so positioned in the home position "ON" such communication being permitted between the spacing predicated upon the depth D' between gear teeth 160'. The home position of gear 122 is preselected to be correlative to the home position of print drum 126.

Referring more particularly to FIGS. 4 and 6, a second stepper motor 170 is fixably mounted by conventional means to another mailing machine support wall 172 such that a portion of the stepper motor's output shaft 174 extends through an aperture 175 in the support wall 172. The shutter bar lever 120 is pivotally mounted to the support wall 172 at one end by any conventional means about a pin 188. Driving communication between the stepper motor 170 and shutter lever 120 is provided by a reciprocation brace 176. The reciprocation brace 176 is comprised of a brace 178 fixably mounted to and radially around the output shaft 174. The brace 178 includes a stub shaft 180. The stub shaft 180 extends parallel and off-center relative to the output shaft 174 such that rotation of the output shaft 174 produces over-center rotation of the stub shaft 180. A connection link 182 is pivotally mounted to the stub shaft 180 at one end. The other end of the connection link 182 is pivotally mounted to the shutter bar lever 120 at a point 186 therealong. As a result, rotation of the stepper motor output shaft 174 causes the control lever 120 experience reciprocating motion about pivot pin 188.

A mounting member 190 is fixably mounted by conventional means to support wall 172. A second optical sensor 192 is fixably mounted to the mounting member 190 by conventional means such that when the shutter bar lever 120 is in a second position a tab 194 formed on the shutter bar lever 120 is in a blocking positioned between the sensor arms 196 and 198 of optical sensor 192 in which position optical communication between the sensor arms 196 and 198 is prevented. Also, mounted to the support wall 172 by conventional means is a adjustable stop assemble 200 comprised of a bracket 202 mounted to support wall 172 and having adjustable mounted to the bracket 202 a stub rod 204. The stop assemble prevents excessive motion of the shutter lever 120 in the blocking direction.

Figure 7:
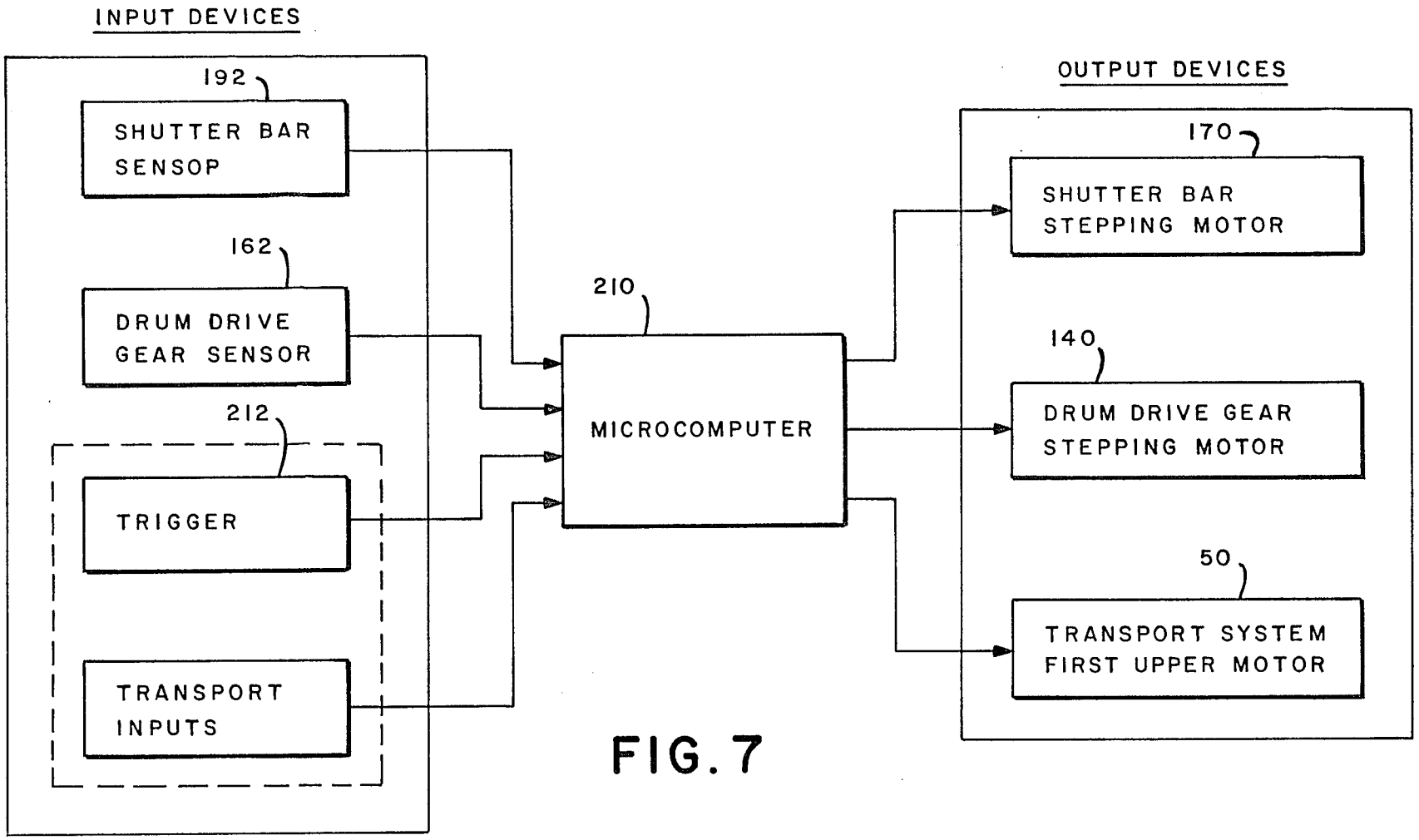
FIG. 7 is a simplified schematic of the control system for the mailing machine postage meter drive assembly in accordance with the present invention.

Referring more particularly to FIG. 7, the microcomputer 210, in the preferred embodiment of the present invention, controls the operation of the mailing machine transport system, in a manner described in U.S. patent application Ser. No. 087,267, and the postage meter drive systems. The microcomputer can be programmed in a manner described in U.S. patent application Ser. No. 087,267, herein incorporated by reference, to permit cooperative variable speed operation of the transport system and the postage meter drive system. It is noted that the transport system can be operated at relatively high speeds. Therefore the marriage of the transport system and the postage meter drive system substantially increases the maximum through-put rate of the postage meter mailing machine without necessitating increased operating speeds. Particularly, the stepper motors 50, 140 and 170 are under the control of a microcomputer 210. The microcomputer 210 is in informed communication with the sensors 162 and 192, and a trigger means 212. The trigger means 212 can be of optical sensor type activated by the presence of a traversing envelope 16.

In operation, a mailpiece discharged from the inserter 14 is received by the mailing machine 10 transport system 28 which controllable delivers the mailpiece 16 for indicia printing by the postage meter 25. As the mailpiece 16 traverses the mailing machine deck 26, at a predetermined position it activates trigger means 212. The trigger means 212 notifies the microcomputer in accordance with the programming of the microcomputer to commence the print cycle after a preselected delay predicated upon the arrival time of the envelope to the printing station.

The shutter bar 121 within the postage meter resides in the aperture 119 of gear 125 such that the gear 125 is free to rotate from the home position by approximately 15 degrees before encountering the shutter bar 121. Accordingly, when the print cycle is commenced by the microcomputer upon triggering by the approaching mailpiece, the stepper motor 170 is activated to cause the withdraw of the shutter bar from its blocking position. Simultaneously, the microcomputer activates the stepper motor 140 to start rotation of gears 122 and 125 to cause the print drum to rotate. The microcomputer is programmed to drive the stepper motor 140 such that the initial acceleration of the print drum is fairly small from the home position. When the print drum 126 is rotated about 4 degrees, the shutter bar 121 should be in the fully released position provided the meter is allowed to dispense the postage. That is, the meter causes bail 130 to be positioned to permit displacement of the shutter bar 121. The optical sensor 122 is blocked when the shutter bar 121 reaches its fully forward or release position. Blocking of the sensor 122 informs the microprocessor to proceed with the print cycle, representing a normal condition. However, in case the shutter bar 121 can not be fully withdrawn from its blocking position within approximately 4 degrees of rotation of the gear 125 predicated upon the restrained shutter bar 121 by pawl 130, the optical sensor 122 remains "ON". Whereupon the microcomputer causes the stepper motor 140 to slow down the print drum quickly to a complete stop within approximately one more degree of rotation. At this time the print drum is about 5 degrees from the home position and the anti-reverse rotation mechanism has not become active. So the print drum can be rotated backward by the microcomputer to its home position per detection by sensor 162. The shutter bar 121 is also driven back to its blocking (print-inhibit) position.

The nominal shutter bar movement time in one direction is about 16 milliseconds, while the entire print cycle time is about 235 milliseconds if the time overlapped method is employed during the shutter forward movement. Without the time overlapped method, the cycle time would be increased to approximately 251 milliseconds, or the driving speed has to be increased by 6.8% to achieve the same throughput.

It is noted that the torque load on the motor is approximately proportional to the square of the speed, and the wear on the moving parts also increases as the speed goes higher. Thus, by the time overlapped technique, the print cycle rate is increased without using larger size motor, and the wear on the meter is reduced, with the additional benefit of prolonging the meter life.

What is claimed is:

1. A mailing machine for mounting of a postage meter thereon said postage meter having a first gear in driving communication with a print drum, a shutter bar mounted within said postage meter for reciprocal motion from a home position wherein said shutter bar is received in a aperture in said first gear and a release position wherein said shutter bar is withdrawn from said aperture and enabling means for enabling said shutter bar to move from said home position to said release position, said enabling means being responsive to a print cycle ready state of said postage meter, comprising:

a base;

means for initiating a postage meter print cycle;

said aperture in said first gear sized to permit a predetermined amount of rotation of said first gear when said shutter bar is in said home position;

a second gear rotatably mounted to said base such that when said postage meter is mounted on said base said second gear is in constant mesh with said first gear;

a gear drive means for controllably driving said second gear;

a shutter lever means for controllably causing said shutter bar to experience reciprocal motion said shutter lever means being positionable from a home position, corresponding to said released position of said shutter bar;

a shutter drive means for driving said shutter lever means;

control means for simultaneously actuating said gear drive means and said shutter drive means upon initiation of said print cycle such that said shutter drive means causes said shutter lever means to assume a home position, prior to said second gear being rotated beyond said predetermined amount from its home position by said gear drive means, should said enabling means prevent said shutter lever means to assume said home position within a preselected rotational distance of said first gear less than said predetermined amount for causing said gear drive means to reverse rotation of said gear means back to its home position.

2. A mailing machine for mounting of a postage meter thereon said postage meter having a first gear in driving communication with a print drum, a shutter bar mounted within said postage meter for reciprocal motion from a home position wherein said shutter bar is received in a aperture in said first gear and a release position wherein said shutter bar is withdrawn from said aperture and enabling means for enabling said shutter bar to move from said home position to said release position, said enabling means being responsive to a print cycle ready state of said postage meter, comprising:

means for initiating a postage meter print cycle;

said aperture in said first gear sized to permit a predetermined amount of rotation of said first gear when said shutter bar is in said home position; within a preselected distance less than said predetermined amount for causing said gear drive means to reverse rotation said second gear means back to its home position.

a second gear rotatably mounted in said base such that when said postage meter is mounted on said base said second gear is in constant mesh with said first gear, said second gear having a corresponding home position to said home position of said shutter bar;

a shutter lever means for causing said shutter bar to experience reciprocal motion from said home position to said release position and a return to said home position, said shutter lever means having a home position corresponding to said releasesd position of said shutter bar;

a shutter drive means for driving said shutter lever means;

a gear drive means for controllably driving said second gear;

sensor means for detecting when said second gear and said shutter lever means are in said home position;

control means in electronic communication with said sensor means and said initiating means for simultaneously actuating a single cycle of said gear drive means and said shutter drive means upon initiation of said print cycle such that said shutter drive means causes said shutter lever means to assume said home position, prior to said second gear being rotated beyond said predetermined amount from its home position by said gear drive means, should said enabling means prevent said shutter lever means from assuming said home position

3. A mailing machine for mounting of a postage meter thereon said postage meter having a first gear in driving communication with a print drum, a shutter bar mounted within said postage meter for reciprocal motion from a home position wherein said shutter bar is received in a aperture in said first gear and a second position wherein said shutter bar is withdrawn from said aperture and enabling means for enabling said shutter bar to move from said home position to said release position, said enabling means being responsive to a print cycle ready state of said postage meter, comprising:

a base having a support wall;

means for initiating a postage meter print cycle;

said aperture in said first gear sized to permit a predetermined amount of rotation of said first gear when said shutter bar is in said home position;

a first stepper motor;

a second gear rotatably mounted in said mailing machine such that when said postage meter is mounted on said mailing machine said postage meter is mounted on said mailing machine said second gear is in constant mesh with said first gear, said second gear having a corresponding home position to said home position of said shutter bar and having from around the outer periphery a plurality of gear teeth, said gear teeth being equally spaced apart and a single non-uniformity between one set of adjacent gear teeth;

means for providing driving communication between said first stepper motor and said second gear;

a second stepper motor;

a shutter lever means for causing said shutter bar to experience reciprocal motion, said shutter lever means having a home position corresponding to said released position of said shutter bar, said shutter lever means having a generally elongated shutter lever pivotally mounted at one to said support wall, a link pivotally mounted at one end to a point along the length of said shutter lever, a bracket fixable mounted to the output shaft of said second stepper motor, said other end of said link being pivotally mounted over center to said bracket;

sensor means for detecting when said second gear and said shutter lever means are in home position, said sensor means having a first optical sensor fixable mounted to said support wall such that said sensor is activated only when said second gear is in. the home position and a second optical sensor fixable mounted to said support wall such that said sensor is activated only when said shutter lever is in the home position; and, control means in electronic communication with said sensor means and said initiating means for simultaneously actuating a single cycle of said gear drive means and said shutter driver means upon initiation of said print cycle such that said shutter drive means causes said shutter lever means to assume a home position, prior to said second gear being rotated beyond said predetermined amount from its home position by said gear drive means, should said shutter lever means be unable to assume said home position within a preselected distance less than said predetermined amount causing said gear drive means to reverse rotate said second gear means back to its home position.

4. A mailing machine for mounting of a postage meter thereon said postage meter having a first gear in driving communication with a print drum, a shutter bar mounted within said postage meter for reciprocal motion from a home position wherein said shutter bar is received in a aperture in said first gear and a release position wherein said shutter bar is withdrawn from said aperture and enabling means for enabling said shutter bar to move from said home position to said release position, said enabling means being responsive to a print cycle ready state of said postage meter, comprising:

means for initiating a postage meter print cycle;

said aperture in said first gear sized to permit a predetermined amount of rotation of said first gear when said shutter bar is in said home position;

a second gear rotatably mounted in said mailing machine such that when said postage meter is mounted on said mailing machine said second gear is in constant mesh with said first gear, said second gear having a corresponding home position to said home position of said shutter bar;

a shutter lever means for causing said shutter bar to experience reciprocal motion from said home position to said release position and return to said home position, said shutter lever means having a home position corresponding to said released position of said shutter bar;

a shutter drive means for driving said shutter lever means;

a gear drive means for controllably driving said second gear;

sensor means for detecting when said second gear and said shutter lever means are in said home position;

control means in electronic communication with said sensor means and said initiating means for simultaneously actuating a single cycle of said gear drive means and said shutter drive means upon initiation of said print cycle such that said shutter drive means causes said shutter lever means to assume said home position, prior to said second gear being rotated beyond said predetermined amount from its home position by said gear drive means, should said enabling means prevent said shutter lever means from assuming said home position within a preselected distance less than said predetermined amount causing said gear drive means to reverse rotate said second gear means back to its home position.

5. A mailing machine as claimed in claim 4, wherein said said control means is a microcomputer.

6. A mailing machine as claimed in claim 5, wherein said gear drive means is a first stepper motor.

7. A mailing machine as claimed in claim 6, wherein said shutter drive means is a second stepper motor.

8. A mailing machine as claimed in claim 7, wherein said mailing machine further comprises a support wall, a stub shaft rotatably mounted in said support wall said second gear being drivenly mounted centrally around said stub shaft, said second gear having from around the outer periphery a plurality of gear teeth, said gear teeth being equally spaced apart and having a single non-uniformity between one set of adjacent gear teeth, and means for providing driving communication between said first stepper motor and said second gear.

9. A mailing machine as claimed in claim 7, wherein said shutter lever means comprises a generally elongated shutter lever pivotally mounted at one to a mailing machine support wall, a link pivotally mounted at one end to a point along the length of said lever, a bracket fixable mounted to the output shaft of said second stepper motor, said other end of said link being pivotally mounted over center to said bracket.

* * * * *